US007378132B2

(12) United States Patent
Renteria et al.

(10) Patent No.: US 7,378,132 B2
(45) Date of Patent: May 27, 2008

(54) METHOD FOR APPLYING ENVIRONMENTAL-RESISTANT MCRALY COATINGS ON GAS TURBINE COMPONENTS

(75) Inventors: Federico Renteria, Greenville, SC (US); Murali N. Madhava, Gilbert, AZ (US); Yiping Hu, Greer, SC (US); Derek Raybould, Denville, NJ (US); Huu-Duc Trinh-Le, Hampstead (CA)

(73) Assignee: Honeywell International, Inc., Morristown, NJ (US)

( * ) Notice: Subject to any disclaimer, the term of this patent is extended or adjusted under 35 U.S.C. 154(b) by 163 days.

(21) Appl. No.: 11/013,218

(22) Filed: Dec. 14, 2004

(65) Prior Publication Data

US 2008/0038575 A1 Feb. 14, 2008

(51) Int. Cl.
*B05D 1/36* (2006.01)
*B05D 3/02* (2006.01)

(52) U.S. Cl. ..... 427/419.1; 420/442; 428/680; 75/246; 427/191; 427/383.1; 427/405

(58) Field of Classification Search ..... 428/680, 428/548; 420/442; 427/191, 383.1, 405, 427/419.1; 75/246
See application file for complete search history.

(56) References Cited

U.S. PATENT DOCUMENTS

| | | | | |
|---|---|---|---|---|
| 3,145,287 | A | 8/1964 | Siebein et al. | |
| 3,676,085 | A | 7/1972 | Evans et al. | |
| 3,958,097 | A | 5/1976 | Fabel et al. | |
| 3,961,098 | A | 6/1976 | Bessen | |
| 4,233,335 | A | 11/1980 | Etlin | |
| 4,246,323 | A | 1/1981 | Bornstein et al. | |
| 4,416,421 | A | 11/1983 | Browning | |
| 4,518,442 | A * | 5/1985 | Chin | 148/675 |
| 4,532,191 | A | 7/1985 | Humphries et al. | |
| 4,680,199 | A | 7/1987 | Vontell et al. | |
| 4,865,252 | A | 9/1989 | Rotolico et al. | |
| 5,059,095 | A | 10/1991 | Kushner et al. | |
| 5,071,059 | A | 12/1991 | Heitman et al. | |
| 5,141,821 | A * | 8/1992 | Lugscheider et al. | 428/614 |
| 5,261,940 | A * | 11/1993 | Berczik | 75/236 |
| 5,268,045 | A | 12/1993 | Clare | |
| 5,302,414 | A * | 4/1994 | Alkhimov et al. | 427/192 |
| 5,732,467 | A | 3/1998 | White et al. | |
| 5,741,556 | A * | 4/1998 | Taylor et al. | 427/453 |

(Continued)

FOREIGN PATENT DOCUMENTS

EP 0 688 886 A1 12/1995

(Continued)

*Primary Examiner*—John J. Zimmerman
*Assistant Examiner*—Aaron Austin
(74) *Attorney, Agent, or Firm*—Ingrassia, Fisher & Lorenz, P.C.

(57) ABSTRACT

There is provided a method for depositing a modified MCrAlY coating on a surface of a gas turbine engine component. The method includes cold gas dynamic spraying techniques to provide a metallurgical bond between a substrate, such as a superalloy substrate, and the modified MCrAlY composition. The method further includes post deposition heat treatments including hot isostatic pressing. The modified MCrAlY composition includes one or more elements of Pt, Hf, Si, Zr, Ta, Re, Ru, Nb, B, and C, which improves the corrosion and environmental resistance of the coated component.

11 Claims, 3 Drawing Sheets

U.S. PATENT DOCUMENTS 5,795,626 A 8/1998 Gabel et al.
5,894,053 A 4/1999 Fried
5,954,275 A 9/1999 Honma et al.
6,120,832 A 9/2000 Walsh et al.
6,296,723 B1 10/2001 Tsantrizos et al.
6,365,222 B1 4/2002 Wagner et al.
6,368,727 B1 4/2002 Ritter et al.
6,410,159 B1 6/2002 Hermanek
6,434,876 B1 8/2002 Wheat et al.
6,444,259 B1 9/2002 Subramanian et al.
6,475,642 B1 * 11/2002 Zhao et al. ..... 428/680
6,491,208 B2 * 12/2002 James et al. ..... 228/119
6,521,293 B1 2/2003 Kojima et al.
6,592,947 B1 7/2003 McCane et al.
6,602,545 B1 8/2003 Shaikh et al.
6,623,798 B2 9/2003 Shin et al.
6,780,458 B2 * 8/2004 Seth et al. ..... 427/201
6,838,191 B1 * 1/2005 Raj ..... 428/675
6,905,728 B1 * 6/2005 Hu et al. ..... 427/142
2002/0005233 A1 * 1/2002 Schirra et al. ..... 148/428
2002/0066770 A1 6/2002 James et al.
2002/0102360 A1 8/2002 Subramanian et al.
2003/0126800 A1 7/2003 Seth et al.
2004/0037654 A1 2/2004 Peterson et al.
2004/0079648 A1 4/2004 Khan et al.
2004/0082069 A1 4/2004 Jiang et al.
2004/0086635 A1 5/2004 Grossklaus, Jr. et al.
2004/0091627 A1 5/2004 Ohara et al.
2004/0126499 A1 7/2004 Heinrich et al.
2004/0202885 A1 10/2004 Seth et al.
2005/0220995 A1 * 10/2005 Hu et al. ..... 427/180
2006/0045785 A1 * 3/2006 Hu et al. ..... 419/5

FOREIGN PATENT DOCUMENTS

EP 1 398 394 A1 3/2004
GB 2 243 841 A 11/1991
WO WO-2004/016819 A1 * 2/2004
WO WO 2004016819 A1 * 2/2004

* cited by examiner

METHOD FOR APPLYING ENVIRONMENTAL-RESISTANT MCRALY COATINGS ON GAS TURBINE COMPONENTS

FIELD OF THE INVENTION

The present invention relates to a modified MCrAlY coating. More particularly the present invention relates to the use of a modified MCrAlY coating as applied onto surfaces of turbine engine components such as turbine blade tips for providing improved component durability. Further, the invention applies to application of the modified MCrAlY coating through the technique of cold gas dynamic spraying.

BACKGROUND OF THE INVENTION

In an attempt to increase the efficiencies and performance of contemporary gas turbine engines, engineers have progressively pushed the engine environment to more extreme operating conditions. The harsh operating conditions of high temperature and pressure that are now frequently specified place increased demands on engine component-manufacturing technologies and new materials. Indeed the gradual improvement in engine design has come about in part due to the increased strength and durability of new materials that can withstand the operating conditions present in the modern gas turbine engine. With these changes in engine materials there has arisen a corresponding need to develop new repair and coating methods appropriate for such materials.

Turbine engines are used as the primary power source for many types of aircrafts. The engines are also auxiliary power sources that drive air compressors, hydraulic pumps, and industrial gas turbine (IGT) power generation. Further, the power from turbine engines is used for stationary power supplies such as backup electrical generators for hospitals and the like.

Most turbine engines generally follow the same basic power generation procedure. Compressed air generated by axial and/or radial compressors is mixed with fuel and burned, and the expanding hot combustion gases are directed against stationary turbine vanes in the engine. The vanes turn the high velocity gas flow partially sideways to impinge on the turbine blades mounted on a rotatable turbine disk. The force of the impinging gas causes the turbine disk to spin at high speed. Jet propulsion engines use the power created by the rotating turbine disk to draw more air into the engine, and the high velocity combustion gas is passed out of the gas turbine aft end to create forward thrust. Other engines use this power to turn one or more propellers, fans, electrical generators, or other devices.

The high pressure turbine (HPT) blade is one engine component that directly experiences severe engine conditions. Turbine blades are thus designed and manufactured to perform under repeated cycles of high stress and high temperature. An economic consequence of such a design criteria is that currently used turbine blades can be quite expensive. It is thus highly desirable to maintain turbine blades in service for as long as possible, and to return worn turbine blades to service, if possible, through acceptable repair procedures.

Turbine blades used in modern gas turbine engines are frequently castings from a class of materials known as superalloys. The superalloys include nickel-, cobalt- and iron-based alloys. In the cast form, turbine blades made from superalloys include many desirable elevated-temperature properties such as high strength and good environment resistance. Advantageously, the strength displayed by this material remains present even under stressful conditions, such as high temperature and high pressure, that are experienced during engine operation.

While the superalloys exhibit superior mechanical properties under high temperature and pressure conditions, they are subject to attack by chemical degradation. The gases at high temperature and pressure in the turbine engine can lead to hot corrosion and oxidation of the exposed superalloy substrates in turbine blades. Those turbine blades at the high pressure stages following the combustion stage of a gas turbine engine are particularly subject to this kind of erosion, and the portion of a turbine blade at the blade tip is even more subject to corrosion and oxidation as this area of the blade also experiences high pressure and temperature. Blade tips are also potential wear points. Corrosion and oxidation are both undesirable in that these processes can lead to the gradual erosion of blade tip material, which affects the dimensional characteristic of the blade as well as physical integrity. In order to protect superalloy turbine blades, a coating may be placed on both the airfoil surfaces, and the blade tip, to act as a barrier between the engine environment and the substrate material.

Among other materials, conventional MCrAlY coatings have been used as one kind of coating on turbine blades to resist corrosion and oxidation. In the conventional formulation of MCrAlY, M represents one of the metals Ni, Co, or Fe or alloys thereof. Cr, Al, and Y are the chemical symbols for Chromium, Aluminum, and Yttrium. Some conventional MCrAlY formulations are discussed in the following U.S. Pat. Nos. 4,532,191; 4,246,323; and 3,676,085. Families of MCrAlY compositions are built around the Nickel, Cobalt, or Iron constituents. Thus the literature speaks of NiCrAlY, NiCoCrAlY, CoCrAlY, CoNiCrAlY, and so on. Nevertheless there is a need to further improve MCrAlY formulations. It would be desired to develop modified MCrAlY formulations that impart improved corrosion and environmental resistance on engine components.

In conventional methods, MCrAlY is applied to a turbine blade as a coating layer through a thermal spray coating process like low pressure plasma spray (LPPS) or electron beam physical vapor deposition (EBPVD). In the thermal spray coating process the MCrAlY coating adheres to the surface of the substrate through mechanical bonding. The MCrAlY coating adheres to asperities previously fashioned onto the substrate surface. This process does not result in a metallurgical or chemical attachment of the MCrAlY material to the underlying substrate. This is described in U.S. Pat. No. 6,410,159. Other deposition techniques that have been used with MCrAlY coatings include CVD, EB/PVD, HVOF, and LPPS. Each of these coating approaches may require complex coating procedures. Additionally expensive equipment such as LPPS, EB/PVD, and sputtering may also be required to apply an overlay coating. Thus, a need exists to utilize a relatively low cost process for applying an MCrAlY coating, as compared to existing methods.

The option of throwing out worn turbine blades and replacing them with new ones is not an attractive alternative. The HPT blades are expensive. A turbine blade made of superalloy can be quite costly to replace, and a single stage in a gas turbine engine may contain several dozen such blades. Moreover, a typical gas turbine engine can have multiple rows or stages of turbine blades. Consequently there is a strong financial need to find an acceptable repair or coating method for superalloy turbine blades.

Hence, there is a need for a turbine engine component coating method that addresses one or more of the above-noted drawbacks. Namely, a method is needed that provides an improved MCrAlY protective layer over the component substrate, and/or a method that allows the efficient and economical deposition of MCrAlY onto a superalloy substrate and/or a modified MCrAlY composition that provides improved properties and durability, and/or a method that by virtue of the foregoing extends turbine blade life and is therefore less costly as compared to the alternative of replacing worn turbine parts with new ones. The present invention addresses one or more of these needs.

SUMMARY OF THE INVENTION

The present invention provides a modified MCrAlY composition, hereinafter designated as modified MCrAlY or MCrAlYX, and a method for using the same as a component coating. The modified MCrAlY material is suitable for deposition onto a superalloy substrate of a gas turbine engine component through cold gas dynamic spraying. The application may include post-deposition heat treatment including HIP treatment. The MCrAlYX coating achieves excellent bonding to the superalloy substrate, and also provides improved performance due to enhanced corrosion and oxidation resistance.

In one exemplary embodiment, and by way of example only, there is provided a method for preparing a coated high pressure turbine blade for assembly in a gas turbine engine comprising the steps of: providing a suitable turbine blade having a surface to be coated; preparing the turbine blade surface for cold gas dynamic spraying; depositing a coating layer on the turbine blade surface by cold gas dynamic spraying a metallic powder composition wherein the powder composition comprises

| Element | Range Weight % |
|---|---|
| Co | about 0-about 35 |
| Cr | about 10-about 25 |
| Fe | about 0-about 35 |
| Al | about 6-about 20 |
| Pt | about 0-about 35 |
| Hf | about 1.0-about 5.0 |
| Si | about 1.0-about 6.0 |
| Nb | about 0-about 15 |
| Zr | about 0-about 5.0 |
| Ta | about 0-about 5.0 |
| Re | about 0-about 5.0 |
| Ru | about 0-about 5.0 |
| B | about 0-about 1.0 |
| C | about 0-about 0.2 |
| Y | about 0.1-about 0.7 |
| Ni | remainder; |

checking the depth of the layer deposited; repeating the steps of depositing and checking the depth until a desired coating thickness is achieved; and heat treating the turbine blade. The step of heat treating the turbine blade comprises a hot isostatic pressing. Optionally a heat treating comprises: heating the turbine blade for about one hour at a temperature between about 1725 and about 1775° F.; cooling the turbine blade, and heating the turbine blade between about two and about eight hours at a temperature between about 900 and about 1100° F. The method may further comprise the step of inspecting the turbine blade through FPI inspection or X-Ray inspection. The method may further include steps of: depositing a first layer of Pt-including powder onto the surface; and depositing a second layer of Pt-free powder on top of the first layer. The step of preparing the turbine blade surface may include one or more of the operations of degreasing, grinding, and grit blasting.

Other independent features and advantages of the method for applying an environmental resistant MCrAlY coating on gas turbine components will become apparent from the following detailed description, taken in conjunction with the accompanying drawings which illustrate, by way of example, the principles of the invention.

DETAILED DESCRIPTION OF A PREFERRED EMBODIMENT

Figure 1:
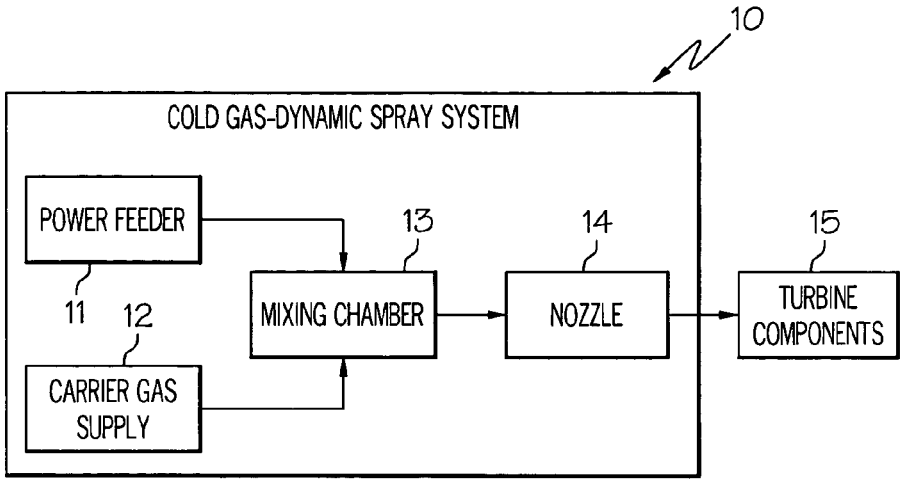
FIG. 1 is a diagrammatic representation of the equipment and apparatus that may be used to perform cold gas dynamic spraying in accordance with an embodiment of the present invention.

Reference will now be made in detail to exemplary embodiments of the invention, examples of which are illustrated in the accompanying drawings. Wherever possible, the same reference numbers will be used throughout the drawings to refer to the same or like parts.

It has now been discovered that a modified MCrAlY, different from convention formulations, offers improved performance characteristics. The modified MCrAlY formulation includes the addition of other elements. Thus, the modified composition is represented by the designation MCrAlYX where X represents the additional constituent not present in conventional formulations.

In a preferred embodiment MCrAlYX represents the formula of the coating material. M is preferably selected from Ni, Co and Fe and/or alloys thereof. Cr is chromium; Al is aluminum, and Y is yttrium. X represents one or more of the following elements: Pt (Platinum), Hf (Hafnium), Si (Silicon), Zr (Zirconium), Ta (Tantalum), Re (Rhenium), Ru (Ruthenium), B (Boron), and C (Carbon). Further X may represent combinations of the designated elements. The composition may also include incidental impurities resulting from typical manufacturing processes. In a preferred embodiment two, three, or four components selected from the group represented by X are included in the modified formulation.

In the modified MCrAlYX formulation the constituents represented by X may provide a function of improving the environmental resistance of the alloy. Thus, the modified MCrAlYX demonstrates improved corrosion and oxidation resistance, especially at high temperatures.

In one embodiment, the MCrAlYX composition includes the following ranges for percentage by weight of each constituent.

| Element | Range Weight % |
|---|---|
| Co | about 0-about 35 |
| Cr | about 10-about 25 |
| Fe | about 0-about 35 |
| Al | about 6-about 20 |
| Pt | about 0-about 35 |
| Hf | about 1.0-about 5.0 |
| Si | about 1.0-about 6.0 |
| Nb | about 0-about 15 |
| Zr | about 0-about 5.0 |
| Ta | about 0-about 5.0 |
| Re | about 0-about 5.0 |
| Ru | about 0-about 5.0 |
| B | about 0-about 1.0 |
| C | about 0-about 0.2 |
| Y | about 0.1-about 0.7 |
| Ni | Remainder. |

In a further preferred embodiment, the MCrAlYX composition described above excludes Platinum. Platinum is an expensive constituent, and it is desirable to provide a formulation that achieves a comparable performance without the use of expensive elements.

In a further preferred composition, the MCrAlYX includes one or more of the elements represented by X. Other embodiments include two or more, three or more, and four or more of the elements represented by X. In the further preferred embodiments of the MCrAlYX composition with less than all the elements represented by X included in the composition, the weight percentage of X in the total composition may fall between about 0 and about 28 per cent. Alternatively, the weight percentage of X in the total formulation may fall between about 0.5 and about 15 per cent. Alternatively and preferably, the weight percentage of X in the total formulation may fall between about 1.0 and about 7.0 per cent.

A preferred specific formulation of the MCrAlYX composition is as follows:

| Element | Weight % |
|---|---|
| Co | about 20 |
| Cr | about 25 |
| Al | about 13 |
| Y | about 0.3 |
| Hf | about 2.0 |
| Si | about 0.65 |
| Nb | about 0.5 |
| Re | about 3.0 |
| B | about 0.1 |
| C | about 0.1 |
| Ni | Remainder. |

A further preferred specific formulation of the MCrAlYX composition is as follows:

| Element | Weight % |
|---|---|
| Co | about 20 |
| Cr | about 22 |
| Al | about 13 |
| Y | about 0.3 |
| Hf | about 2.0 |
| Si | about 0.65 |
| Re | about 3.0 |
| Ru | about 1.5 |

-continued

| Element | Weight % |
|---|---|
| Nb | about 0.5 |
| B | about 0.1 |
| C | about 0.1 |
| Ni | Remainder. |

An additional preferred specific formulation of the MCrAlYX composition is as follows:

| Element | Weight % |
|---|---|
| Co | about 20 |
| Cr | about 25 |
| Al | about 13 |
| Y | about 0.4 |
| Hf | about 2.0 |
| Si | about 0.80 |
| Nb | about 0.5 |
| B | about 0.1 |
| C | about 0.1 |
| Ni | Remainder. |

The MCrAlYX composition is particularly intended for use as a coating on turbine blade surfaces. As such it is particularly adapted for use with turbine blades made of advanced superalloys. Thus some specific turbine substrates for which the composition is adapted for use include the following superalloys: IN-738, IN-792, MarM 247, C 101, Rene 80, Rene 125, Rene 142, GTD 111, Rene N5, CMSX 4, SC 180, PWA 1480, and PWA 1484.

The MCrAlYX composition described herein can be manufactured as a powder for use in depositions using a cold gas dynamic spraying technique. In one embodiment, an alloy including all elemental constituents is first prepared. The alloy material may be put in powderized form by conventional powder processing methods, such as inert gas atomization from ingots. Alternatively, non-alloyed powder blends may be prepared by mixing separate powders of individual elements or alloys. In a final powder composition prepared in this manner the weight percentage of each elemental constituent corresponds to the ranges earlier provided. A preferred diameter for the metallic powder particles, regardless how formed, is between about 5 to about 50 microns.

The MCrAlYX compositions described above demonstrate improved performance with respect to oxidation resistance and corrosion resistance. Turbine blade tips coated with such materials are better able to withstand the corrosive and oxidative forces encountered in a gas turbine engine.

In a preferred method, the MCrAlYX composition is deposited on a turbine blade as a coating through a cold gas dynamic spraying process. Referring now to FIG. 1 there is shown an exemplary cold gas dynamic spray system 10 illustrated diagrammatically. The system 10 is illustrated as a general scheme, and additional features and components can be implemented into the system 10 as necessary. The main components of the cold gas dynamic spray system 10 includes a powder feeder 11 for providing repair powder materials, a carrier gas supply 12 (typically including a heater), a mixing chamber 13 and a convergent-divergent nozzle 14. In general, the system 10 mixes the repair particles with a suitable pressurized gas in the mixing chamber 13. The particles are accelerated through the specially designed nozzle 14 and directed toward a target surface on the turbine component 15. When the particles strike the target surface, converted kinetic energy causes plastic deformation of the particles, which in turn causes the particle to form a bond with the target surface. Thus, the cold gas dynamic spray system 10 can bond powder materials to a gas turbine engine component surface.

The cold gas dynamic spray process is referred to as a "cold gas" process because the particles are mixed and applied at a temperature that is far below the melting point of the particles. The kinetic energy of the particles on impact with the target surface, rather than particle temperature, causes the particles to plastically deform and bond with the target surface. Therefore, bonding to the component surface takes place as a solid state process with insufficient thermal energy to transition the solid powders to molten droplets.

According to the present invention, the cold gas-dynamic spray system 10 applies metallic powdered materials that may be difficult to weld or otherwise apply to component surfaces. For example, welding processes involving superalloy substrates are conventionally performed in a well-shielded atmosphere such as an inert gas chamber or a chamber that is under vacuum. Maintaining such a controlled environment is inefficient in terms of both time and expense. In contrast, the cold gas-dynamic spray system 10 can be operated at ambient temperature and pressure environments.

Figure 2:
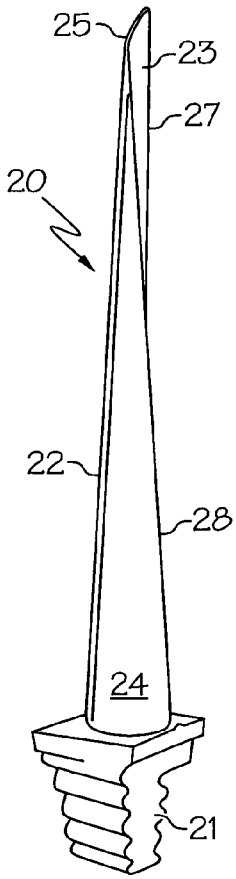
FIG. 2 is a perspective view of a turbine blade such as may be processed in accordance with an embodiment of the present invention.

While the method of applying modified MCrAlY powders may be applied to a variety of gas turbine engine components, it is well-suited to coating high pressure turbine blades. A typical turbine blade 20 is illustrated in FIG. 2. Turbine blade geometry and dimension have been designed differently, depending on turbine engine model and its application. For aero engines, such a blade is typically several inches in length. A turbine blade includes a serrated base assembly 21, also called a mounting dovetail, tang, or christmas tree. Airfoil 22, a cuplike structure, includes a concave face 23 and a convex face 24. In the literature of turbine technology airfoil 22 may also be referred to as a bucket. Turbine blade 20 also includes leading edge 27 and trailing edge 28 which represent the edges of airfoil 22 that firstly and lastly encounter an air stream passing around airfoil 22. Turbine blade 20 also include tip 25. Tip 25 may include raised features known as "squealers" (not shown) in the industry. Turbine blade 20 is often composed of a highly durable material such as a superalloy. It is also desirable to cast turbine blades in a single crystal superalloy in order to maximize elevated-temperature properties and dimensional stability.

Figure 3:
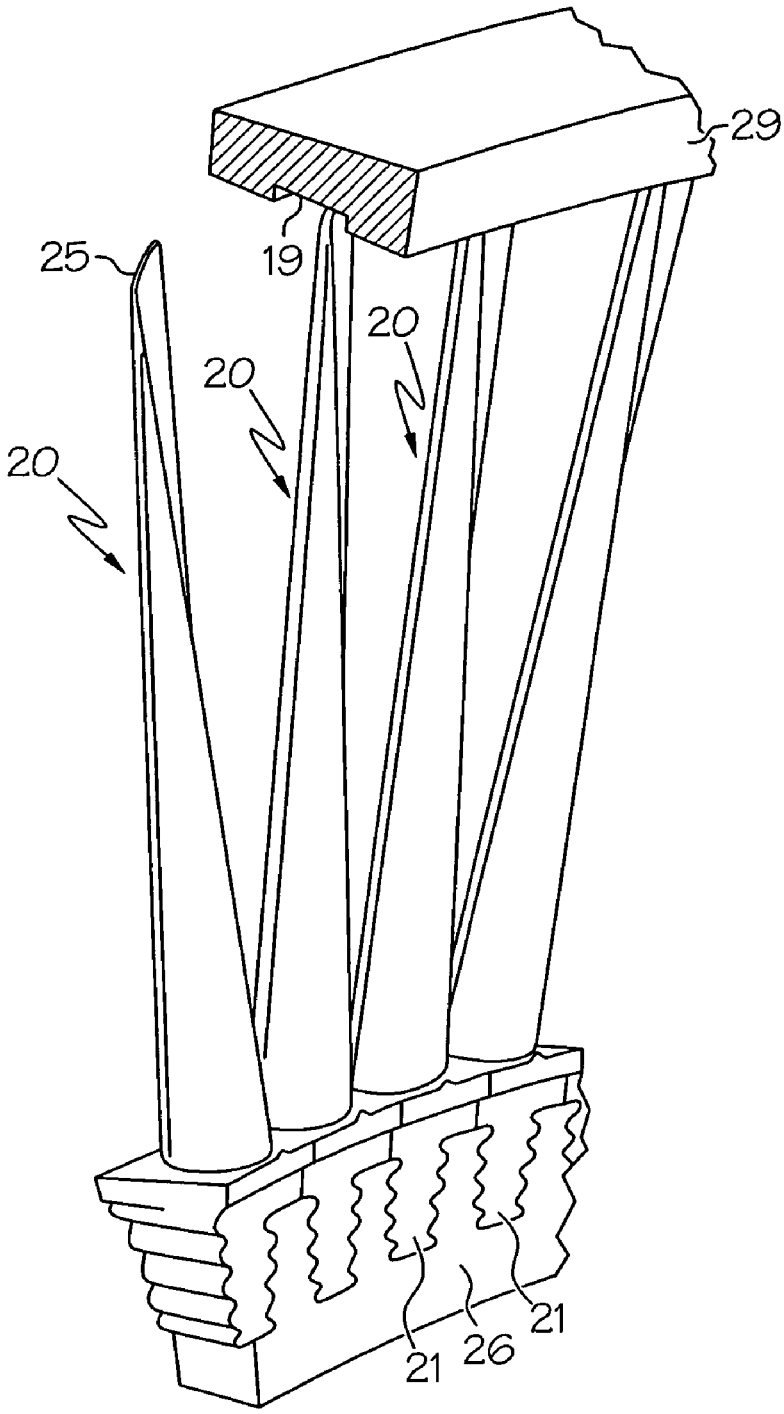
FIG. 3 is a perspective view of a part of a turbine rotor assembly including turbine blades as may be processed according to an embodiment of the invention.

Referring now to FIG. 3 turbine blade 20 is affixed to a hub 26 at base assembly 21. Airfoil 22 extends radially outwardly from hub 26 toward shroud 29. In a jet engine assembly multiple such turbine blades are positioned in adjacent circumferential position along hub 26. Many gas turbine engines have a shroud structure 29. Shroud 29 surrounds a row of turbine blades at the upper (outer radial) end of turbine blade 20. Further shroud 29 includes groove 19. Turbine blades 20 are disposed so that tip 25 is within the area defined by groove 19. In operation, gases impinge on concave face 23 of airfoil 22 thereby providing the driving force for the turbine engine. Further the close fit of blade tip 25 within groove 19 minimizes the escape of gases around the turbine stage, thus increasing engine efficiency. The passage of hot gases through the gap between tip 25 and groove 19 leads to high temperature and pressure conditions at tip 25. Thus blade tips 25 may be coated with a hardened or protective layer to resist mechanical wear as well as corrosion and oxidation.

Examples of other components which may be treated with a modified MCrAlY coating include compressor blades, blisks or integrally bladed rotors (IBRs) and impellers or centrifugal compressors, which have blades that are integral to the rotor hub, nozzles, ducts, shrouds, shroud supports, and vanes.

Having described the MCrAlYX composition and cold gas dynamic spraying apparatus from a structural standpoint, a method of using such an assembly in a coating deposition with MCrAlYX will now be described.

Figure 4:
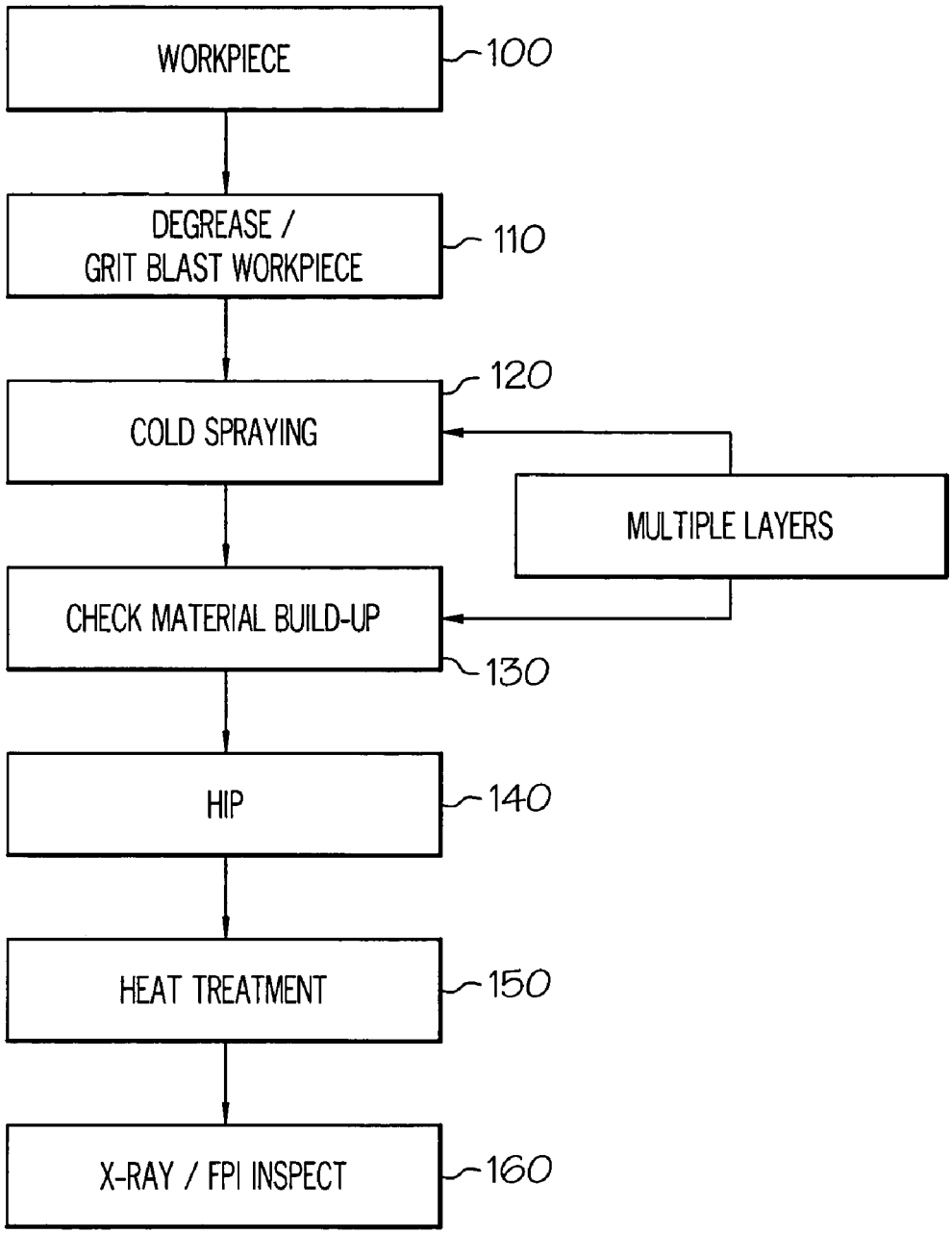
FIG. 4 is an exemplary functional block diagram of a coating process using the cold gas dynamic spray deposition of MCrAlYX powder as a coating on an HPT turbine blade.

Referring now to FIG. 4, there is shown a functional block diagram of the steps in one embodiment of the cold gas dynamic spraying process. This method includes the cold gas dynamic spray process, and also includes additional optional processes to optimize the resulting repairs. Cold gas dynamic spray involves "solid state" processes to effect bonding and coating build-up, and does not rely on the application of external thermal energy for bonding to occur. However, thermal energy may be provided after bonding has occurred since thermal energy promotes formation of the desired microstructure and phase distribution for the repaired components. Also, additional processing may be necessary to optimize bonding within the material and many thermo-mechanical properties for the material such as the elastic/plastic properties, mechanical properties, thermal conductivity and thermal expansion properties. In the method additional optional processing includes hot isostatic pressing and additional thermal treatments to consolidate and homogenize the cold gas-dynamic spray applied material and to restore metallurgical integrity to the repaired component.

A suitable workpiece is first identified in step 100. Inspection of the workpiece confirms that the workpiece is a suitable candidate for operation by a cold spray process. The workpiece should not suffer from mechanical defects or other damage that would disqualify it from service, after receiving the coating treatment.

Step 110 reflects that the workpiece may be subjected to a pre-processing treatment to prepare the piece for welding. In one embodiment a surface of the component/workpiece receives a pre-treatment machining and degreasing in order to remove materials that interfere with cold spraying such as corrosion, impurity buildups, and contamination on the face of the workpiece. In addition the piece may receive a grit blasting with an abrasive such as aluminum oxide.

After these preparatory steps, deposition of coating material commences in step 120 through cold gas spraying. In cold gas dynamic spraying, particles at a temperature below their melting temperature are accelerated and directed to a target surface on the turbine component. When the particles strike the target surface, the kinetic energy of the particles is converted into plastic deformation of the particle, causing the particle to form a strong bond with the target surface. The spraying step can include the application of coating material to a variety of different components in a gas turbine engine. For example, material can be applied to surfaces on compressor blades, turbine blades, impellers, and vanes in general, and to airfoil surfaces such as tips, knife seals, leading/trailing edges, and platforms.

The deposition of a coating layer through cold gas spraying may occur over several deposition cycles. A first pass takes place 120. After a first pass, the coating thickness of the first layer is checked, step 130. If the build-up of material is below that desired, a second pass occurs, a repeat of step 120, on top of the first layer. The thickness of material deposited is then checked again, step 130. In this manner a series of material deposition steps are repeated, if necessary, through repetitions of steps 120 and 130. Thus a series of spraying passes can build up a desired thickness of newly deposited MCrAlYX. A preferred thickness is up to 0.050 inch. Likewise, a series of spraying passes may be required in order to cover a desired surface area with subsequent spraying passes depositing material adjacent to coatings from earlier spraying passes.

Post spraying steps may also include procedures such as heat treatment. One preferred treatment is hot isostatic pressing (HIP) step 140. HIP is a high temperature, high-pressure process. The HIP process can be performed at a desired temperature that is sufficient to fully consolidate the cold-sprayed buildup and eliminate defects such as porosity. Additionally, the HIP process strengthens bonding between the coating material buildup and the underlying component, homogenizes the applied materials, and rejuvenates microstructures in the base material. Overall mechanical properties such as tensile and stress rupture strengths of repaired gas turbine components can thus be dramatically improved with the HIP process.

As one example of HIP parameters, pressing can be performed for 2 to 4 hours at temperatures of between about 1650 and about 1750° F. and at pressures of about 10 to about 15 ksi for most superalloys, although the procedure is carried out at up to about 30 ksi for some high-temperature alloys. Of course, this is just one example of the type of hot isostatic pressing process that can be used to remove defects after the application of repair materials.

In some embodiments, it may be desirable to perform a rapid cool following the HIP process to reduce the high-temperature solution heat treatment aftermath that could otherwise exist. One advantage of the rapid cool capability is that the component alloy and the coating material are retained in "solution treated condition," reducing the need for another solution treatment operation. In other words, the HIP followed by rapid cool can provide a combination of densification, homogenization and solution treat operation. Using this technique can thus eliminate the need for other heat treatment operations.

The next step 150 comprises performing an optional heat treatment on the coated component. The heat treatment can provide a full restoration of the mechanical properties of turbine components. It should be noted that in some applications it may be desirable to delete the high temperature solution treatment if such operation can be accomplished in step 140. However, some examples of heat treatments are described below for applications in which such a treatment is desired or necessary.

A two-stage heat treatment useful for components with superalloy substrates is applied in a first example. According to this example, a coated component is heated for about one hour at a temperature between about 1725 and about 1775° F. After cooling the component with water, the component is heated between about two and about eight hours at a temperature between about 900 and about 1100° F.

Another two-stage heat treatment is applied in a second example. According to this second example, a compressor blade or other component is heated for about one hour at a temperature between about 1550 and about 1650° F. The component is air cooled, and then heated between about four and about eight hours at a temperature between about 1075 and about 1125° F.

According to a third example, a component is heated for about one hour at a temperature between about 1800 and about 1850° F. The component is then cooled with water or oil. The component is then heated between about four and about eight hours at a temperature between about 1050 and about 1100° F.

Finally, an FPI (Fluorescent Penetration Inspection) inspection of a component such as a turbine blade, as well as an x-ray inspection, step 160, may follow. At this time the component may be returned to service, or placed in service for the first time.

A particular embodiment of the method to deposit the MCrAlYX composition is described as follows. As above-mentioned it is often the case that several deposition layers are required in order to build up an overall desired coating thickness of the MCrAlYX material. While MCrAlYX compositions which include Pt are desirable, it becomes expensive to deposit an entire coating, with multiple layers, made of a Pt-including MCrAlYX composition. It has thus been discovered that improved corrosion and oxidation resistance can be achieved where only certain deposition layers comprise the Pt-including MCrAlYX composition and the remaining deposition layers comprise the MCrAlYX composition without Pt, that is Pt-free MCrAlYX. Thus, for example, in a three layer deposition, the first layer may be composed of a Pt-free MCrAlYX, the second layer a Pt-including MCrAlYX, and the third layer a Pt-free MCrAlYX. Various combinations are thus possible, so long as some layers of the overall coating include Pt and others do not.

A variety of different systems and implementations can be used to perform the cold gas dynamic spraying process. For example, U.S. Pat. No. 5,302,414, entitled "Gas dynamic Spraying Method for Applying a Coating" and incorporated herein by reference, describes an apparatus designed to accelerate materials having a particle size diameter of between 5 to about 50 microns, and to mix the particles with a process gas to provide the particles with a density of mass flow between 0.05 and 17 g/s-cm$^2$. Supersonic velocity is imparted to the gas flow, with the jet formed at high density and low temperature using a predetermined profile. The resulting gas and powder mixture is introduced into the supersonic jet to impart sufficient acceleration to ensure a particle velocity ranging between 300 and 1200 m/s. In this method, the particles are applied and deposited in the solid state, i.e., at a temperature which is considerably lower than the melting point of the powder material. The resulting coating is formed by the impact and kinetic energy of the particles which gets converted to high-speed plastic deformation, causing the particles to bond to the surface. The system typically uses gas pressures of between 5 and 20 atm, and at a temperature of up to 800° F. As non limiting examples, the gases can comprise air, nitrogen, helium and mixtures thereof. Again, this system is but one example of the type of system that can be adapted to cold spray powder materials to the target surface.

The present invention thus provides an improved method for coating turbine engine components. The method utilizes a cold gas dynamic spray technique to coat turbine blades, compressor blades, impellers, blisks, and other turbine engine components. These methods can be used to coat a variety of surfaces thereon, thus improving the overall durability, reliability and performance of the turbine engine itself.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method for preparing a coated high pressure turbine blade for assembly in a gas turbine engine comprising the steps of:

providing a suitable turbine blade having a surface to be coated;

preparing the turbine blade surface for cold gas dynamic spraying;

depositing a first coating layer on the turbine blade surface by cold gas dynamic spraying a powder composition of pre-alloyed metals wherein the pre-alloyed metals in the powder composition comprise

| Element | Range Weight % |
|---|---|
| Co | about 0-about 35 |
| Cr | about 10-about 25 |
| Fe | about 0-about 35 |
| Al | about 6-about 20 |
| Pt | about 0-about 35 |
| Hf | about 1.0-about 5.0 |
| Si | about 1.0-about 6.0 |
| Nb | about 0-about 15 |
| Zr | about 0-about 5.0 |
| Ta | about 0-about 5.0 |
| Re | about 0-about 5.0 |
| Ru | about 0-about 5.0 |
| B | about 0-about 1.0 |
| C | about 0-about 0.2 |
| Y | about 0.1-about 0.7 |
| Ni | remainder; and |

repeating the step of depositing to form a second coating layer having the same metallic composition as the first layer, wherein one of the first and second coating layers includes Pt, and the other of the first and second coating layers is Pt-free.

2. The method according to claim 1 further comprising the step of heat treating the turbine blade.

3. The method according to claim 2 wherein the step of heat treating the turbine blade comprises a hot isostatic pressing comprising heating the turbine blade for approximately 2 to 4 hours at temperatures of between about 1650 and about 1750° F. and at pressures of about 10 to about 15 ksi.

4. The method according to claim 2 wherein the step of heat treating the turbine blade comprises a hot isostatic pressing treatment at a pressure up to about 30 ksi.

5. The method according to claim 2 wherein the step of heat treating comprises:

heating the turbine blade for about one hour at a temperature between about 1725 and about 1775° F.;

cooling the turbine blade, and heating the turbine blade between about two and about eight hours at a temperature between about 900 and about 1100° F.

6. The method according to claim 2 wherein the step of heat treating comprises:

heating the turbine blade for about one hour at a temperature between about 1550 and about 1650° F.;

cooling the turbine blade, and heating the turbine blade between about four and about eight hours at a temperature between about 1075 and about 1125° F.

7. The method according to claim 2 wherein the step of heat treating comprises:

heating the turbine blade for about one hour at a temperature between about 1800 and about 1850° F.;

cooling the turbine blade, and heating the turbine blade between about four and about eight hours at a temperature between about 1050 and about 1100° F.

8. The method according to claim 1 wherein the turbine blade surface comprises a turbine blade tip.

9. The method according to claim 1 further comprising the step of inspecting the turbine blade through FPI inspection or X-Ray inspection.

10. The method according to claim 1 wherein the step of depositing a coating layer on the turbine blade surface by cold gas dynamic spraying further comprises:

providing a powder particle size with diameter of between 5 to about 50 microns;

mixing the particles with a process gas to provide a density of mass flow between 0.05 and 17 g/s-cm$^2$; and accelerating the particles to a velocity ranging between 300 and 1200 m/s.

11. The method according to claim 1 wherein the step of preparing the turbine blade surface comprises at least one of the operations selected from the group consisting of degreasing, grinding, and grit blasting.

* * * * *